US010281116B2

(12) United States Patent
Zuo

(10) Patent No.: US 10,281,116 B2
(45) Date of Patent: May 7, 2019

(54) LAMP

(71) Applicant: ZOWEER LIGHTING CO., LTD., Shenzhen (CN)

(72) Inventor: Yi-Zhao Zuo, Shenzhen (CN)

(73) Assignee: ZOWEER LIGHTING CO., LTD., Shenzhen (CN)

( * ) Notice: Subject to any disclaimer, the term of this patent is extended or adjusted under 35 U.S.C. 154(b) by 0 days.

(21) Appl. No.: 15/846,002

(22) Filed: Dec. 18, 2017

(65) Prior Publication Data

US 2018/0106463 A1 Apr. 19, 2018

Related U.S. Application Data

(63) Continuation-in-part of application No. PCT/CN2015/081709, filed on Jun. 17, 2015.

(51) Int. Cl.

| | |
|---|---|
| ***F21V 3/00*** | (2015.01) |
| ***F21V 17/10*** | (2006.01) |
| ***F21V 19/00*** | (2006.01) |
| ***F21V 23/02*** | (2006.01) |
| ***F21V 31/00*** | (2006.01) |
| *F21V 29/76* | (2015.01) |
| *F21Y 115/10* | (2016.01) |
| *F21V 3/06* | (2018.01) |
| *F21V 17/16* | (2006.01) |

(Continued)

(52) U.S. Cl.

CPC ..... *F21V 17/101* (2013.01); *F21V 19/0015* (2013.01); *F21V 23/023* (2013.01); *F21V 31/005* (2013.01); *F21V 3/062* (2018.02); *F21V 17/16* (2013.01); *F21V 17/18* (2013.01); *F21V 23/001* (2013.01); *F21V 29/76* (2015.01); *F21W 2131/10* (2013.01); *F21Y 2115/10* (2016.08)

(58) Field of Classification Search

CPC ..... F21V 17/00; F21V 5/04; F21Y 2101/02
USPC ..... 362/311.01
See application file for complete search history.

(56) References Cited

U.S. PATENT DOCUMENTS

2013/0027935 A1* 1/2013 Ladewig ..... F21S 2/00 362/249.01
2013/0329434 A1* 12/2013 Packard ..... F21V 19/04 362/311.01

(Continued)

FOREIGN PATENT DOCUMENTS

CN 201277477 Y 7/2009
CN 201297546 Y 8/2009

(Continued)

*Primary Examiner* — Ahshik Kim
(74) *Attorney, Agent, or Firm* — ScienBiziP, P.C.

(57) ABSTRACT

The present disclosure relates to a lamp. The lamp comprising a light source module and a shell module. The light source module comprising a circuit board provided with a plurality of light-emitting elements and a fixing ring. The fixing ring comprising an annular substrate, a sidewall connected to an outer edge of the annular substrate, and at least two flanges disposed on an outer surface of the sidewall. The circuit board is disposed on the annular substrate and surrounded by the sidewall. The shell module comprising a base. The base comprising a first surface, a second surface on an opposite side of the first surface, a receiving cavity formed on the first surface, and at least two sliding slots defined on an inner wall of the receiving cavity. The at least two flanges are received in the at least two sliding slots.

18 Claims, 10 Drawing Sheets

(51) Int. Cl.

| | |
|---|---|
| *F21V 17/18* | (2006.01) |
| *F21V 23/00* | (2015.01) |
| *F21W 131/10* | (2006.01) |

(56) References Cited

U.S. PATENT DOCUMENTS

| | | | | |
|---|---|---|---|---|
| 2014/0268767 | A1* | 9/2014 | Hatch | F21V 15/01<br>362/249.02 |
| 2016/0348861 | A1* | 12/2016 | Bailey | F21S 8/026 |

FOREIGN PATENT DOCUMENTS

| | | | |
|---|---|---|---|
| CN | 201652001 | U | 11/2010 |
| CN | 201935132 | U | 8/2011 |
| CN | 202915247 | U | 5/2013 |
| CN | 203464184 | U | 3/2014 |
| CN | 204268139 | U | 4/2015 |
| CN | 204300839 | U | 4/2015 |

* cited by examiner

LAMP

FIELD

The subject matter herein generally relates to lamps, and particularly, to a lamp for outdoor lighting.

BACKGROUND

Existing lamps, especially lamps for outdoor lighting, each lamp usually comprising a light source, a shell and a power supply. The light source and the power supply are usually separately fixed on the shell by fixing structures such as a number of screws, etc., which causes a complicated assembly process for manufacturing lamps, and increases labor costs.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Figure 1:
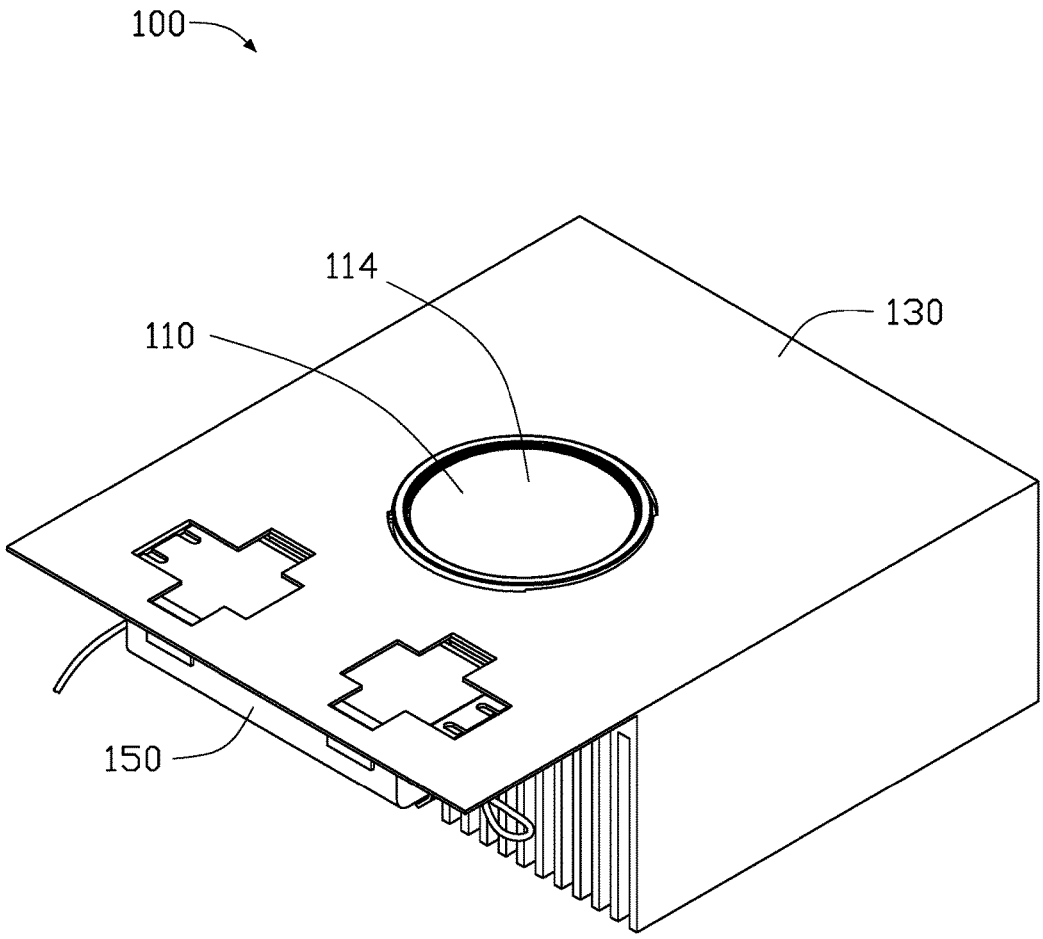
FIG. 1 is an isometric view of a first exemplary embodiment of a lamp.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The present disclosure, including the accompanying drawings, is illustrated by way of example and not by way of limitation. It should be noted that references to "an" or "one" embodiment in this disclosure are not necessarily to the same embodiment, and such references mean "at least one".

Figure 2:
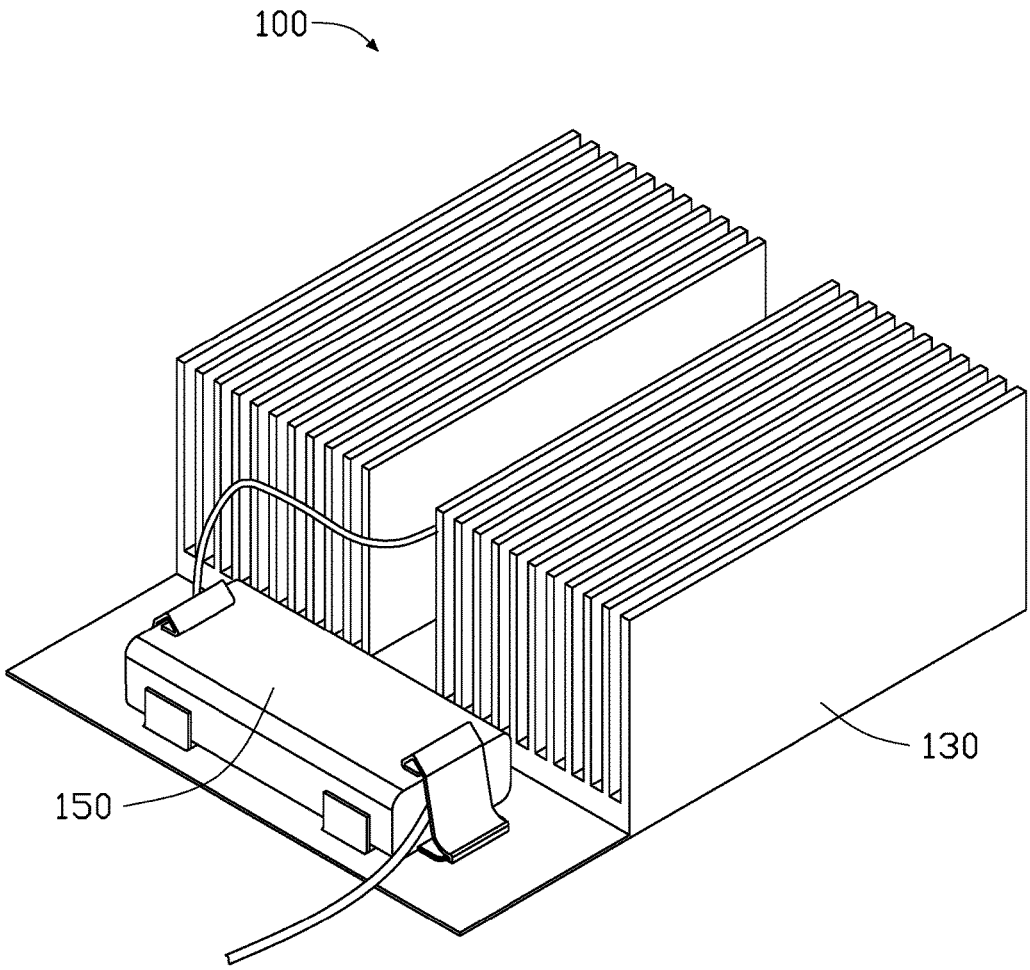
FIG. 2 is similar to FIG. 1, but viewed from another perspective.

The purpose of the present disclosure is to provide a lamp which is simpler to assemble, easier to transport, and having lower cost. Referring to FIGS. 1-2, FIG. 1 is an isometric view of a first exemplary embodiment of a lamp 100, FIG. 2 is similar to FIG. 1, but viewed from another perspective. The lamp 100 comprising a light source module 110, a shell module 130, and a power module 150. The light source module 110 and the power module 150 are both fixed on the shell module 130. The power module 150 also electrically connects to the light source module 110 for supplying power to the light source module 110.

Figure 3:
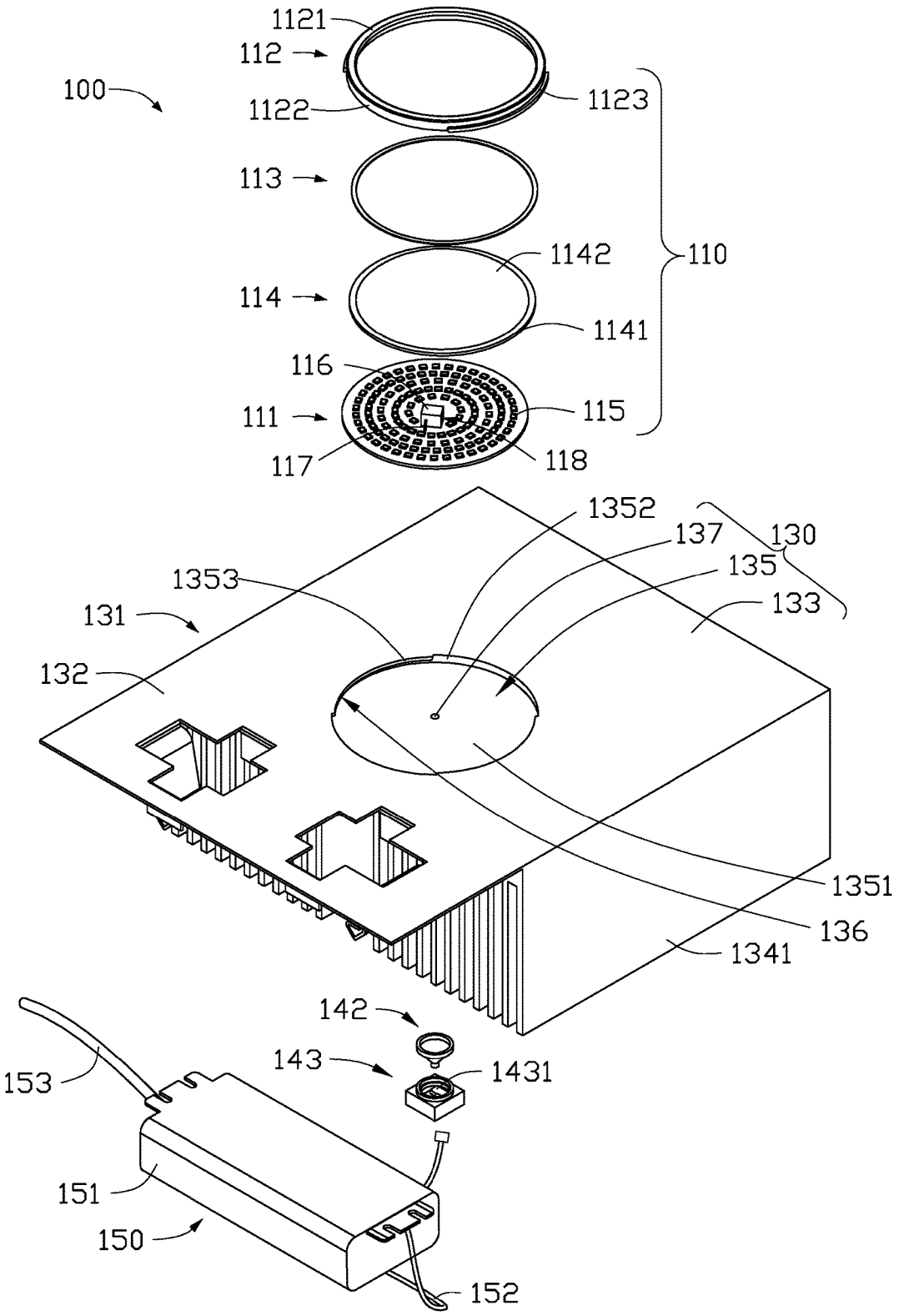
FIG. 3 is an exploded view of the lamp of FIG. 1.
Figure 4:
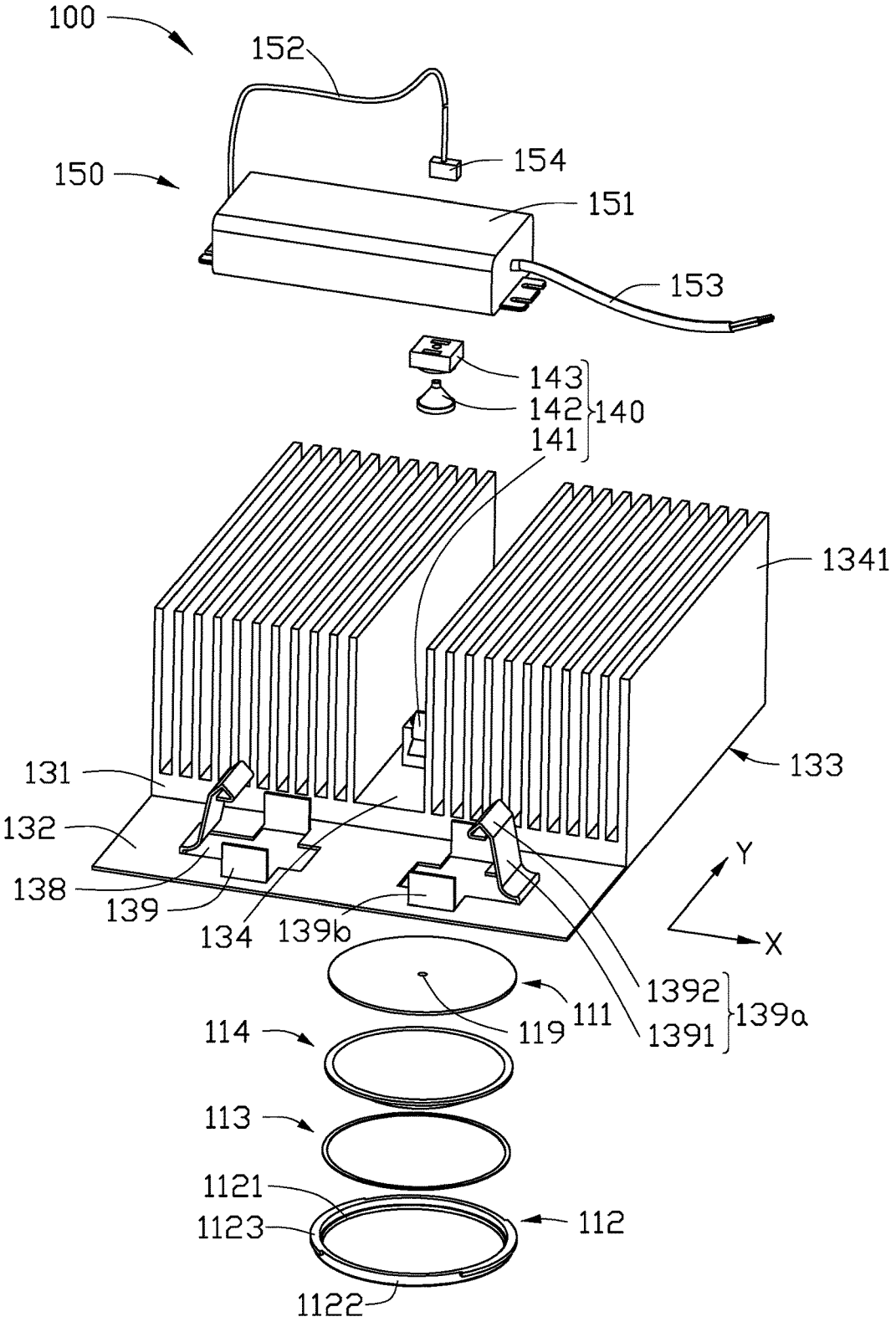
FIG. 4 is similar to FIG. 3, but viewed from another perspective.

Specifically, referring to FIGS. 3-4, FIG. 3 is an exploded view of the lamp of FIG. 1, FIG. 4 is similar to FIG. 3, but viewed from another perspective. In the present embodiment, the light source module 110 comprising a circuit board 111 provided with a plurality of light-emitting elements 115, a fixing ring 112, a rubber ring 113 and a lens 114. The fixing ring 112, the rubber ring 113, the lens 114 and the circuit board 111 are sequentially stacked. The plurality of light-emitting elements 115 can be light-emitting diodes, such as white light-emitting diodes. The plurality of light-emitting elements 115 can radially dispose on the circuit board 111. The circuit board 111 is circular. It can be understood that the circuit board 111 comprising conducting wires inside to electrically connect the plurality of light-emitting elements 115. The circuit board 111 further comprising a power terminal 116 formed on the circuit board 111 and defines a through hole 119 penetrating the circuit board 111. Preferably, the power terminal 116 is an electrical connector and electrically connects to the circuit board 111 through a conducting wire 117. The power terminal 116 comprising a port 118. The port 118 can accommodates electrical connectors electrically connected external conducting wires (e.g. the conducting wire 152 of the power module 150) so as to electrically connects to an external circuit (e.g. the power module 150). The through hole 119 defined on the circuit board 111 is used to allow the external conducting wire to pass through so as to avoid ugly appearance of the lamp 100 when the external conducting wire is exposed.

The fixing ring 112 comprising an annular substrate 1121, a sidewall 1122 connected to an outer edge of the annular substrate 1121, and two flanges 1123 disposed on an outer surface of the sidewall 1122. Preferably, the material of the fixing ring 112 is metal, such as stainless steel. In this embodiment, it can be understood that the fixing ring 112 comprising the two flanges 1123, and the length of each flange 1123 is about one quarter of the circumference of the fixing ring 112. But in other embodiments, the fixing ring 112 can also be provided with three flanges, four flanges or more flanges. Preferably, the distance between two adjacent flanges is the same. The rubber ring 113 is made of elastic material, such as rubber. The size of the rubber ring 113 is substantially the same as the size of the annular substrate 1121. The lens 114 is made of transparent material, such as plastic, and the lens 114 comprising an annular edge portion 1141 and a lens portion 1142 located in the middle of the annular edge portion 1141. The lens portion 1142 connects to the annular edge portion 1141. The size of the annular edge portion 1141 is substantially the same as the size of the annular substrate 1121. The lens portion 1142 is an arc structure protruded toward the rubber ring 113 and the fixing ring 112. The rubber ring 113, the lens 114 and the circuit board 111 are sequentially received in a receiving space surrounded by the annular substrate 1121 and the side wall 1122, and the lens portion 1142 is exposed to the outside of the lamp 100 through the opening defined on the rubber ring 113 and the opening defined on the fixing ring 112. In this embodiment, the rubber ring 113 is sandwiched between the annular substrate 1121 and the lens 114 for preventing external moisture from entering. In other embodiments, the rubber ring 113 can be set between the lens 114 and the circuit board 111, which also can be used for preventing external moisture from entering.

The shell module 130 comprising a base 131 and a fixing plate 132 connected to the base 131. The base 131 and the fixing plate 132 can be integrated and made of the same material, and the same material can be metal, such as stainless steel. The base 131 comprising a first surface 133, a second surface 134 on the opposite side of the first surface 133, a receiving cavity 135 formed on the first surface 133 toward the second surface 134, and two sliding slots 136 oppositely defined on an inner wall of the receiving cavity 135. The two flanges 1123 of the fixing ring 112 can be rotated and received in the two sliding slots 136 for the circuit board 111 and the lens 114 and the rubber ring 113 receiving in the receiving cavity. Specifically, the base 131 comprising a bottom surface 1351, an inner sidewall 1352 connected to the bottom surface 1351, and two extending walls 1353. The bottom surface 1351 and inner sidewall 1352 define the receiving cavity 135. The two extending walls 1352 are oppositely disposed and extend from an upper end of the inner sidewall 1352 towards a center of the receiving cavity 135. The two extending walls 1353, the inner sidewall 1352, and the bottom surface 1351 cooperatively define the two sliding slots 136. During assembly, the two flanges 1123 of the fixing ring 112 accommodating the rubber ring 113, the lens 114, and the circuit board 111 are respectively received in the receiving cavity 135. A pressure is applied downward to rotate the fixing ring 112 to guide the two flanges 1123 slide into the two sliding slots 136 respectively, so that the light source module 110 is fixed on the base 131 of the shell module 130.

The base 131 further defines an outlet hole 137 in a bottom surface 1351 of the receiving cavity 135, and the outlet hole 137 passes through the base 131, and a waterproof buckle 140 located on the second surface 134 of the base 131 and opposite to the outlet hole 137. The waterproof buckle 140 comprising a base body 141 formed on the base 131, a waterproof ring 142, and a clip 143. The outlet hole 137 is configured for passing an external conducting wire (such as the conducting wire 152) which passes through the through hole 119 in the circuit board 111 to connect the power module 150. The waterproof buckle 140 is also used for waterproofing the outlet hole 137 when the external conducting wire passes through to prevent external water vapor from entering the receiving cavity 135 through the outlet hole 137 to damage the circuit board 111. The base 131 further comprising a plurality of fins 1341 formed on the second surface 134 for heat dissipation for the lamp 100. The plurality of fins 1341 can be spaced apart from each other to facilitate heat dissipation.

The fixing plate 132 defines two openings 138 and comprising a number of fasteners 139 connected to the edge of one of the two openings 138. The number of fasteners 139 comprising two first fasteners **139*a* and four second fasteners 139*b*. The two first fasteners 139*a* are arranged along the first direction X and oppositely disposed, and two of the four second fasteners 139*b* are oppositely disposed, and the other two of the four second fasteners 139*b* are oppositely disposed, and the two oppositely disposed second fasteners 139*b* are arranged in a second direction Y perpendicular to the first direction X. The first fastener 139*a* comprises a holding plate 1391 connected to the edge of the opening 138 and a hook structure 1392 connected to an edge of the holding plate 1391. The hook structure 1392 is prismatic shape, such as triangular prism. The hook structure 1392 can be formed by continuously bending one end of the holding plate 1391, and the cross-section of the hook structure 1392 can be a triangular ring. One end of the holding plate 1391 connected to the edge of the opening 138 is formed an arc shape which toward the opening 138, and the plate body of the holding plate 1391 can be slightly inclined with respect to the plate surface of the fixing plate 132. The second fastener 139*b* has a rectangular plate shape and is perpendicularly connected to the fixing plate 132. The fixing plate 132 can be pressed upward to form the multiple fasteners 139 and the openings 138, so that the multiple fasteners 139 and the fixing plate 132 are integrated, not only simple to make, but also to ensure a better connection strength. In this embodiment, the fixing plate 132 extends from a side of the base 131, and the fixing plate 132 can also be perpendicularly connected to the base 131 and extend from the base 131. Preferably, the fixing plate 132 and the plurality of fins 1341 are both located on a same side of the base 131 to make the shape of the lamp 100** more beautiful.

The power module 150 comprising a power supply body 151 and a first conducting wire 152 and a second conducting wire 153. The first conducting wire 152 and the second conducting wire 153 are connected to the power supply body 151. The power supply body 151 has a substantially rectangular parallelepiped shape. It can be understood that the power supply body 151 comprising a metal shell (such as an aluminum alloy shell) and a circuit structure disposed inside the metal shell. The first conducting wire 152 is configured for electrically connecting the power supply body 151 with the circuit board 111 of the light source module 110. One end of the first conducting wire 152 is connected to the power supply body 151, and the other end of the first conducting wire 152 is provided with an electrical connector 154. The first conducting wire 152 can pass through the waterproof buckle 140, the outlet hole 137 of the base 131, the through hole 119 of the circuit board 111 electrically connected to the power terminal 116 of the circuit board 111. Specifically, the electrical connector 154 can be inserted into and fixed in the port 118 of the power terminal 116 so as to electrically connect the light source module 110 with the power module 150. The second conducting wire 153 is configured for electrically connecting the power module 150 with an external power source, such as connected to the external AC via the plug, socket and other electrical components.

The power supply body 151 is disposed on the fixing plate 132, preferably, the power body 151 and the fins 1341 are located on the same side of the base 131. Specifically, the power supply body 151 is received in a space surrounded by the number of fasteners 139. The bottom surface of the power supply body 151 is disposed on the fixing plate 132, and the holding plate 1391 of the first fastener **139*a* clamps a side surface of the power supply body 151. The hook structure 1392 is buckled on the top surface of the power supply body 151 which is away from an end of the fixing plate 132, and one side surface of the prism of the hook structure 1392 resists against the top surface of the power supply body 151. The opposite second fasteners 139*b* holds two opposite sides of the power supply body 151, so that the power supply body 151 is tightly fixed by the first fasteners 139*a* and the second fasteners 139*b*** along the first direction X and the second direction Y.

Figure 5:
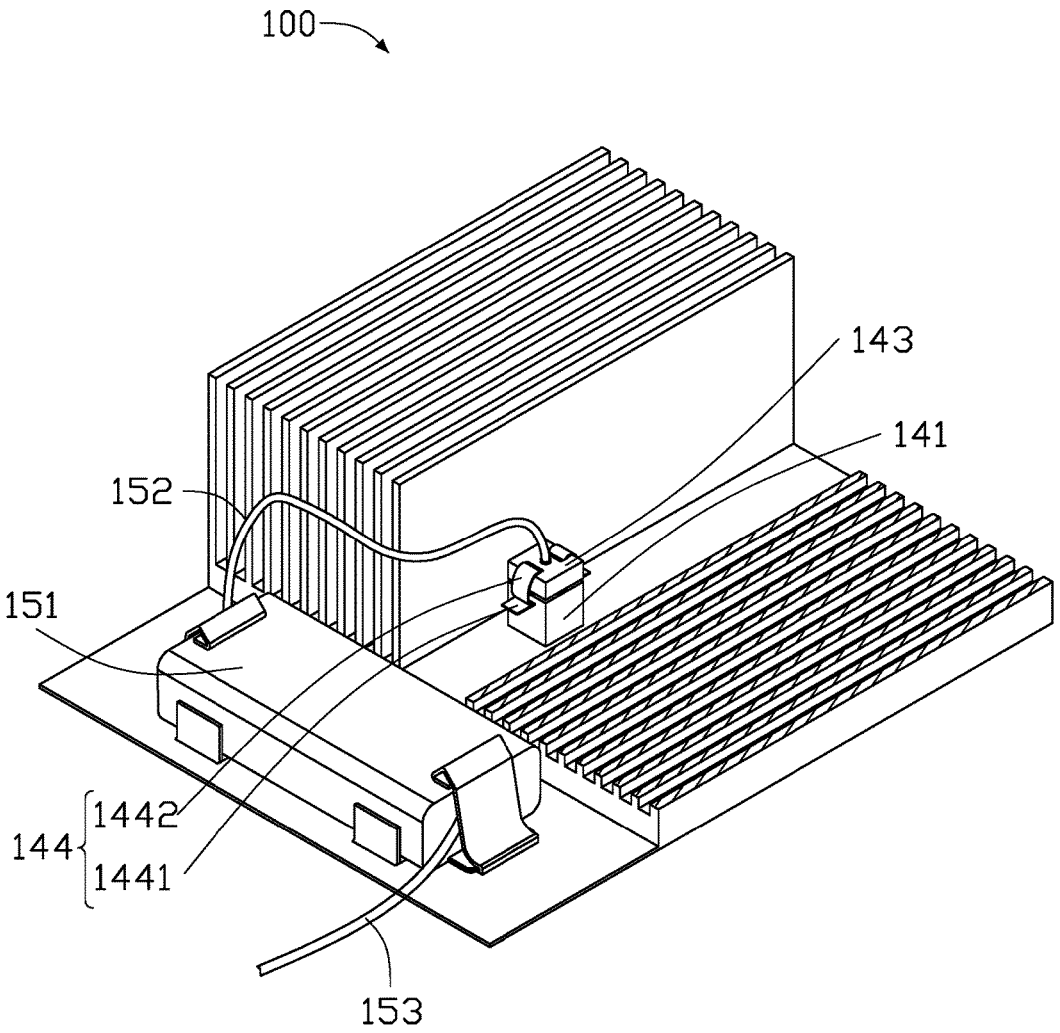
FIG. 5 is similar to FIG. 2, but without a part of the fins 1341.
Figure 6:
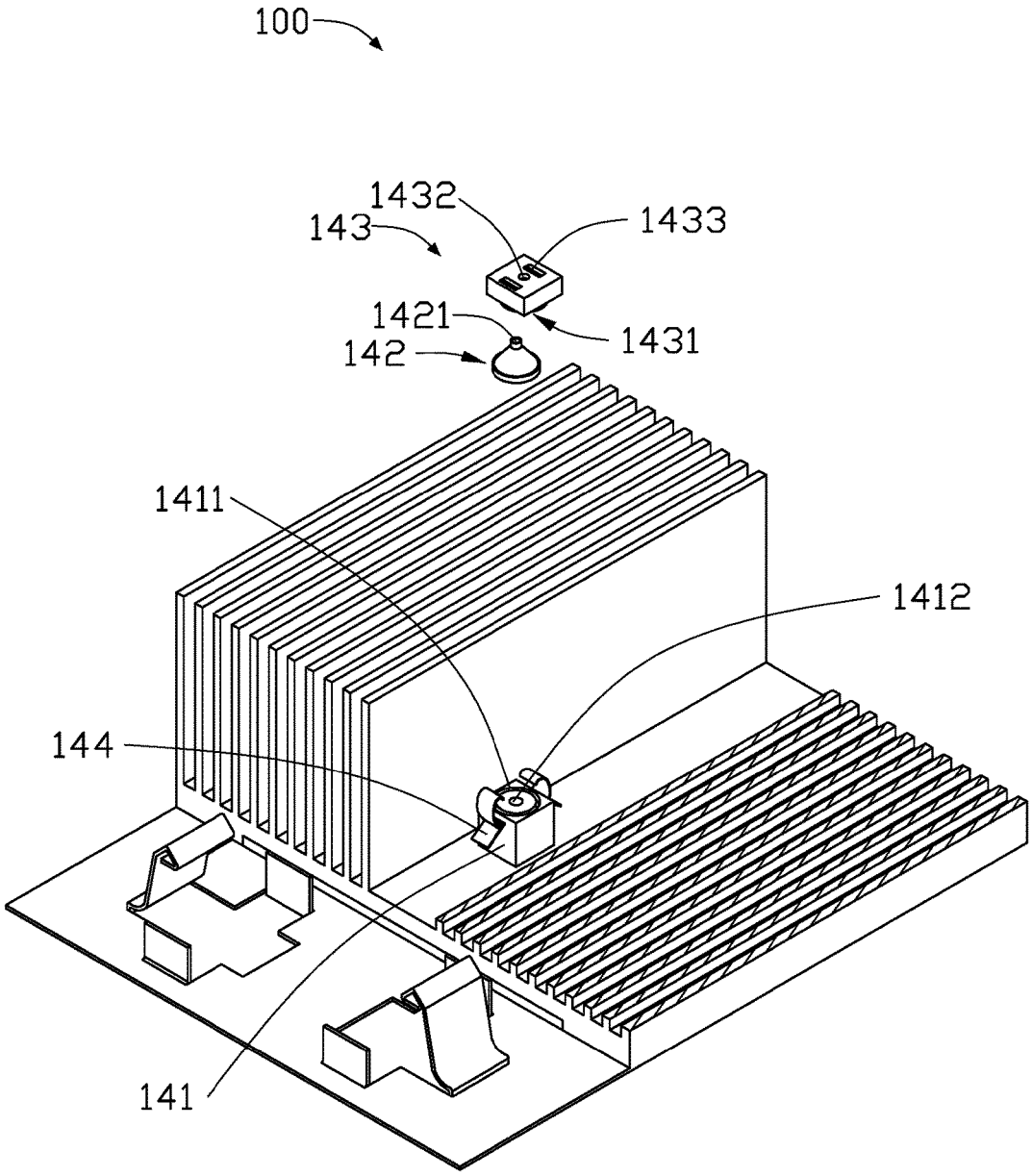
FIG. 6 is an exploded view of the lamp of FIG. 5.

Referring to FIGS. 5-6, FIG. 5 is similar to FIG. 2, but without a part of the fins 1341, FIG. 6 is an exploded view of the lamp of FIG. 5. FIG. 5 and FIG. 6 are mainly used to show the specific structure and composition of the waterproof buckle 140. The base body 141 of the waterproof buckle 140 defines a through hole 1411 penetrating the outlet hole 137 and a receiving space 1412 adjacent to the waterproof ring 142, and two elastic buckles 144 respectively extending from two sides of the base body 141. The base body 141 can be directly formed on the base 131, and can be made of metal. The elastic buckle 144 comprising an elastic plate 1441 extending from the lateral side of the base body 141 and an arc-shaped clamping member 1442 located on a side of the elastic plate 1441 and adjacent to the waterproof ring 142. Preferably, the elastic buckle 144 is a steel spring. The two arc-shaped clamping members 1442 of the two elastic buckle 144 are both bent inward and oppositely disposed. The waterproof ring 142 is substantially funnel-shaped and defines a through hole 1421, and the waterproof ring 142 can be made of rubber. The clip 143 defines a receiving space 1431, and a through hole 1432. The clip 143 comprising two latching slots 1433 for clipping with the two elastic buckles 144 respectively. One end of the first conducting wire 152 of the power module 150 is electrically connected to the circuit board 111, and the other end of the first conducting wire 152 sequentially passes through the outlet hole 137 of the base 131, the through hole 1411 of the base body 141, the through hole 1421 of the waterproof ring 142, and the through hole 1432 of the clip 143 to electrically connected to the power supply body 151. The larger end of the waterproof ring 142 is received in the receiving space 1412 of the base body 141, and the smaller end of the waterproof ring 142 is received in the receiving space 1431 of the buckle 143. The elastic buckle 144 and the latching slot 1433 of the clip 143 corporately fix the waterproof ring 142 and the clip 143 on the base body 141.

When an external force is applied to the elastic plate 1441 to lead the arc-shaped clamping member 1442 to move away from the clip 143, the arc-shaped clamping member 1442 is opened. Then, one end of the waterproof ring 142 is placed in the base body 141, and the clip 143 is placed on the waterproof ring 142 so that the receiving space 1431 receives the other end of the waterproof ring 142. And then, an external force is applied to the elastic plate 1441 to lead the arc-shaped member 1442 to move toward the clip 143, so that one end of the arc-shaped member 1442 is clipped with the latching slot 1433 of the clip 143. When removing the waterproof buckle 140, an external force can be further applied to the two arc-shaped clamping members 1442, so that when the two arc-shaped clamping members 1442 can move away from the clip 143, and the two arc-shaped clamping members 1442 are opened and disengaged from the latching slot 1433 to release the clip 143.

Compared with the prior art, the lamp 100 provided by the present disclosure provides the circuit board 111 which can be rotatably clipped on the shell module 130 by the fixing ring 112, no screw assembly is required between the light source module 110 and the shell module 130, so that the lamp 100 can be assembled more easily and the assembly labor cost can be reduced. In addition, buckling by rotation avoids the problem of hard to disassemble by direct buckle and easy to damage the buckle, and fixed reliability is higher.

Furthermore, in the present disclosure, the power module 150 and the shell module 130 are fastened by a plurality of fasteners 139 formed on the fixing plate 132, no screw assembly is needed between the power module 150 and the shell module 130, so that the lamp 100 is easy to assemble and can reduce the labor cost of assembly. Furthermore, as the case of the lamp 100 assembly is relatively simple, the light source module 110 and the shell module 130 can temporarily not be assembled before transport, and be assembled when necessary, which can further reduce transportation and assembly costs. In addition, because the lamp 100 is assembled without screws, thus the disassembly is relatively simple, which is more convenient to replace components of the light source module 110, the shell module 130 and the power module 150. Furthermore, through some structural settings, such as the rubber ring 113 and the waterproof buckle 140, water vapor can be effectively prevented from entering the light source module 110, so that problems such as poor circuit caused by rainwater are effectively prevented when the lamp 100 is used outdoors, and also provides a higher degree of reliability.

Figure 7:
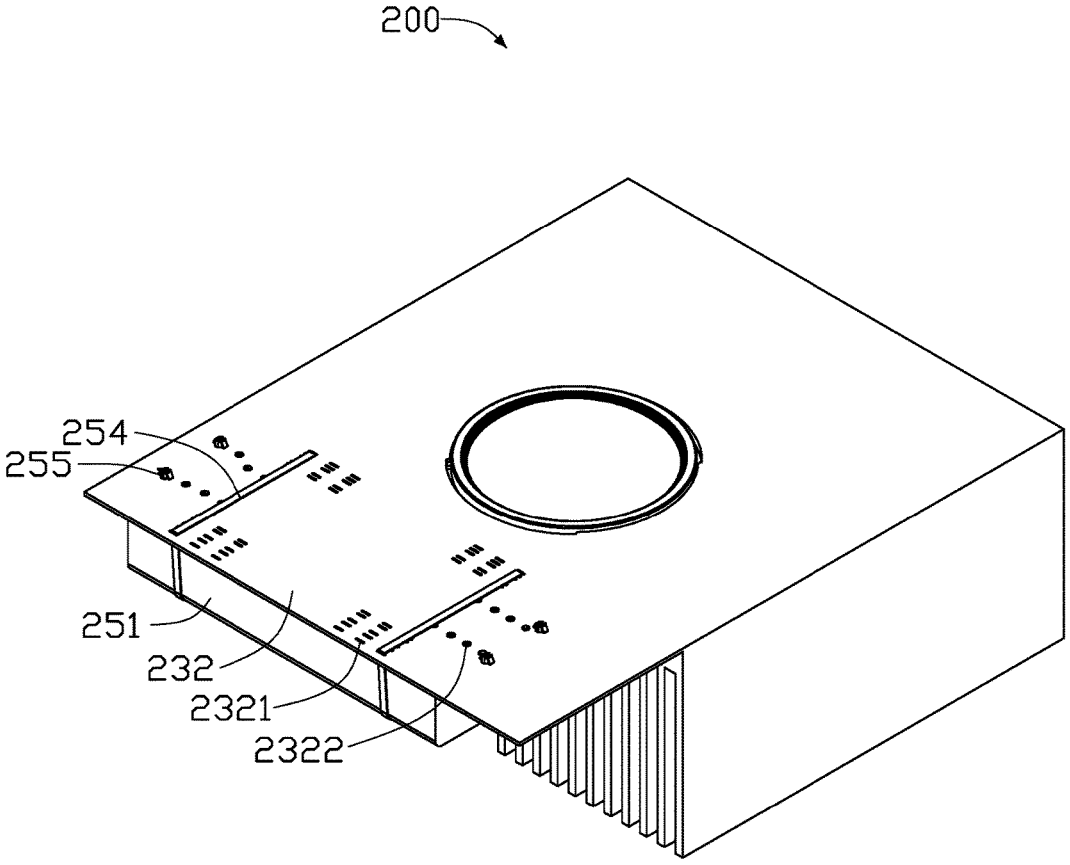
FIG. 7 is an isometric view of a second exemplary embodiment of a lamp.
Figure 8:
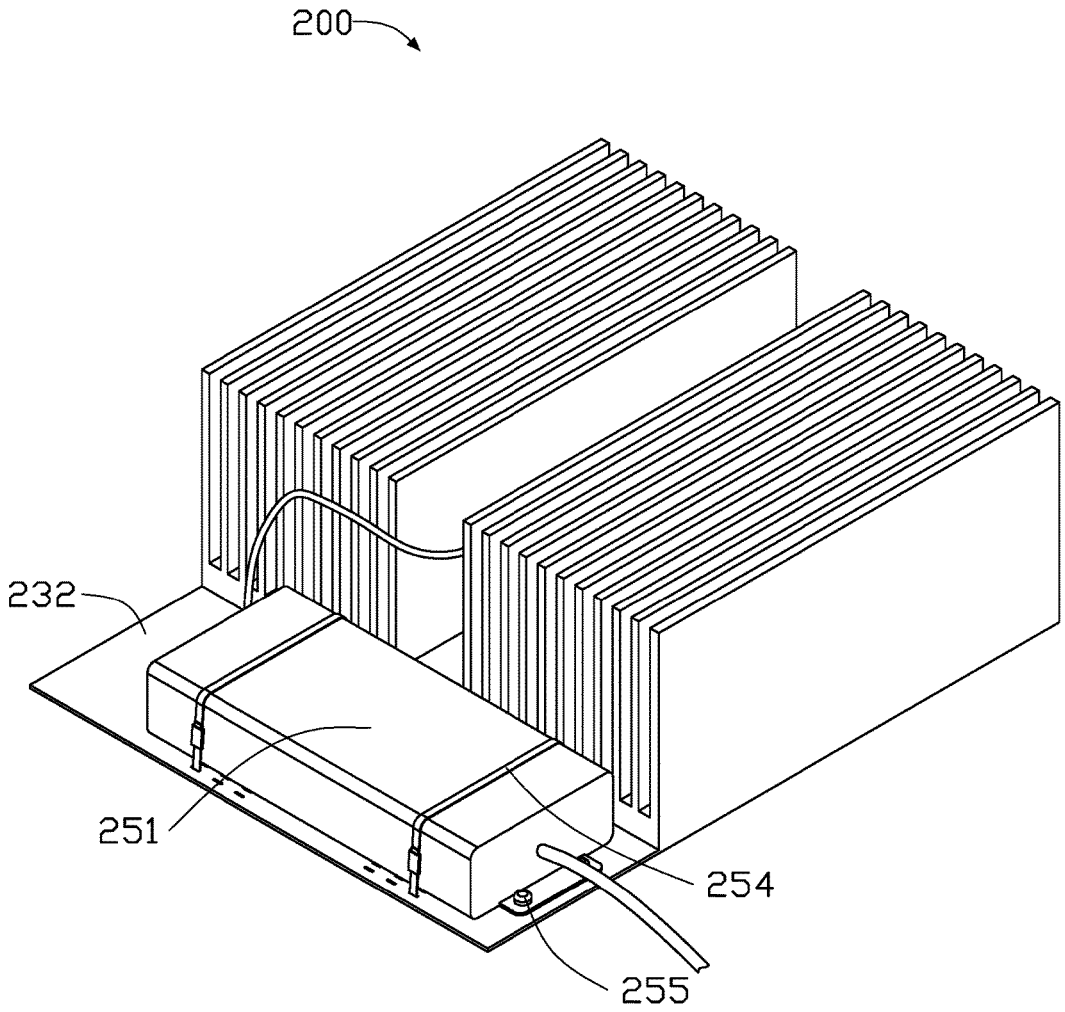
FIG. 8 is similar to FIG. 7, but viewed from another perspective.
Figure 9:
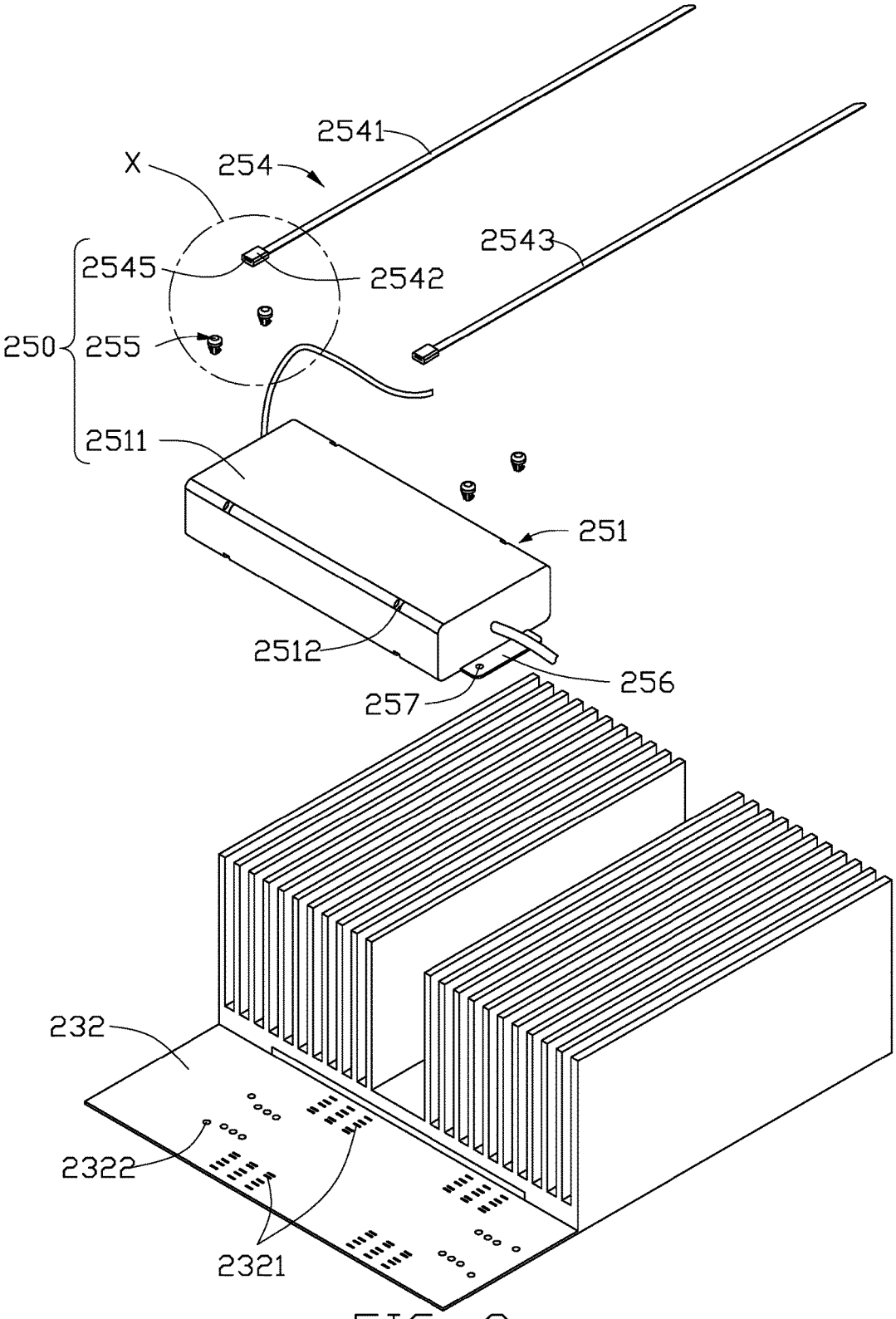
FIG. 9 is an exploded view of the lamp of FIG. 8.

Referring to FIGS. 7-9, FIG. 7 is an isometric view of a second exemplary embodiment of a lamp 200. FIG. 8 is similar to FIG. 7, but viewed from another perspective. FIG. 9 is an exploded view of the lamp of FIG. 8. The structure of the lamp 200 of the second exemplary embodiment is similar to the lamp 100 of the first exemplary embodiment. The main differences between the first exemplary embodiment and the second exemplary embodiment are: the structure of the fixing plate 232, and the structure and the fixing manner of the power module 250. Specifically, in the second exemplary embodiment, the fixing plate 232 defines a plurality of pairs of through holes 2321 and a plurality of rivet holes 2322. The power module 250 comprising a power supply body 251, two fixing straps 254 and four rivets 255. The power supply body 251 is disposed on the fixing plate 232, and comprising a shell 2511, a plurality of recesses 2512 and two fixing pieces 256. The plurality of recesses 2512 formed at the junction of a top surface and two side surfaces of the shell 2511 and the junction of a bottom surface and two side surfaces of the shell 2511. The two fixing pieces 256 extend from the bottom surface of the shell 2511 and are oppositely disposed, and each of the fixing piece 256 defines at least one perforation 257. The material of the shell 2511 and the fixing piece 256 can be metal, such as aluminum.

Figure 10:
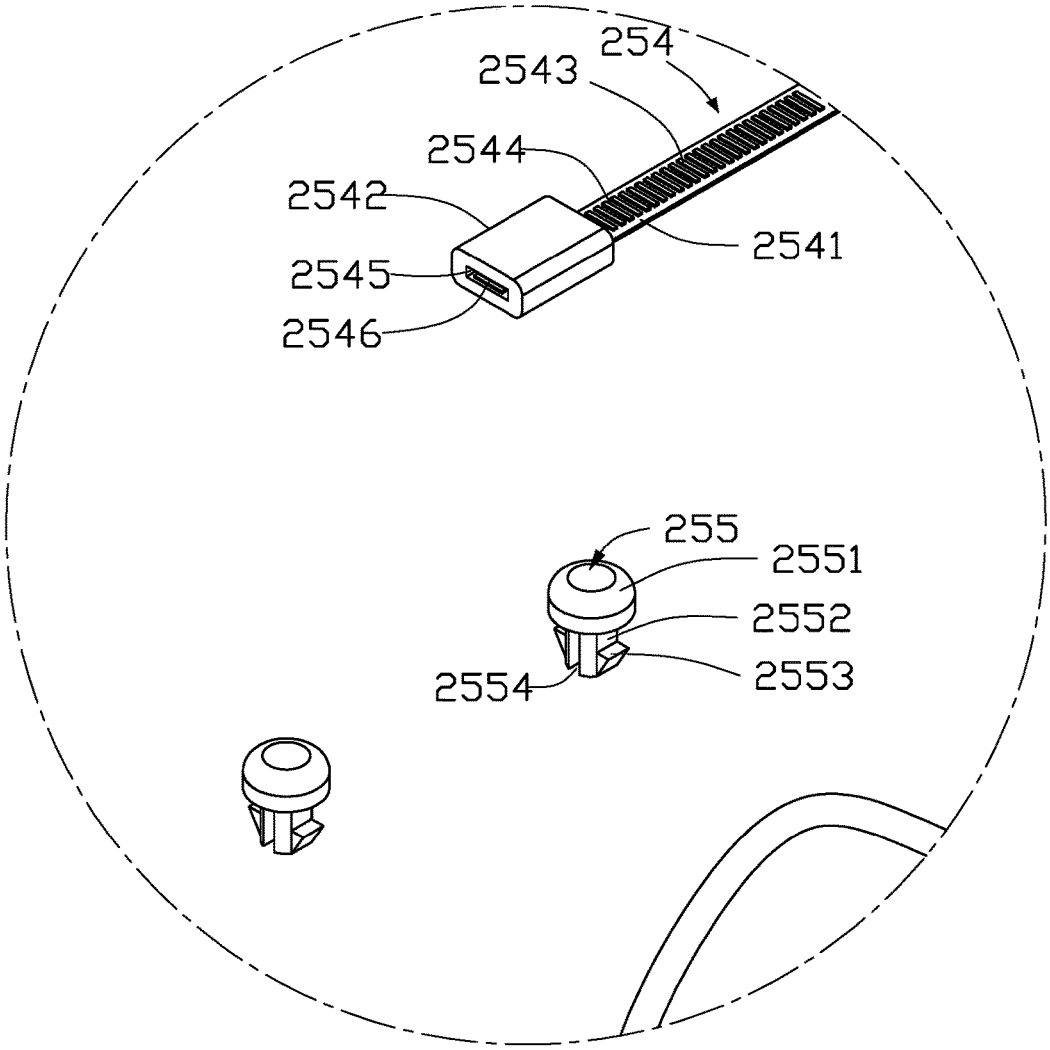
FIG. 10 is a partial, enlarged view of FIG. 9.

Referring to FIG. 10, FIG. 10 is a partial, enlarged view of FIG. 9. The fixing strap 254 comprising a strap 2541 and a buckle 2542 connected to one end of the strap 2541. A plurality of ribs 2543 protrudes from the strap 2541, and a limiting slot 2544 is defined between adjacent ribs 2543. The buckle 2542 defines a through hole 2545 and comprising a limiting member 2546 received in the through hole 2545. The other end of the strap 2541 which is away from the buckle 2542 sequentially passes through a pair of through holes 2321 on the fixing plate 232 and surrounds the power supply body 251, and the buckle 2542 locks the other end of the strap 2541 such that the power supply body 251 is fixed on the fixing plate 232. Specifically, the other end of the strap 2541 passes through the through hole 2545 of the buckle 2542. The limiting member 2546 is received in one limiting slot 2544 between adjacent ribs 2543, and the buckle 2542 locks the other end of the strap 2541, so that the power supply body 251 is fastened to the fixing plate 232. Simultaneously, a portion of the strap 2541 is received in the recesses 2512 of the shell 2511, to prevent the power supply body 251 being displaced. Preferably, the material of the buckle 2542 is metal, and the material of the strap 2541 can also be metal.

Furthermore, each rivet 255 comprising a cap portion 2551 and a nail portion 2552 connected to the cap portion 2551. The nail portion 2551 comprising two outwardly facing hooks 2553. A gap 2554 is defined between the two hooks 2553, so that the nail portion 2552 can occur elastic deformation when passing through the perforation 257 and the rivet hole 2322, and then be fixed on the fixing plate 232, so as to further strengthen the fixing strength of the power supply body 251. The material of the rivet hole 255 can be plastic, so that the nail portion 2552 can be directly cut off with scissors to complete the disassembly of the rivet 255 when removing the power supply body 251. Furthermore, a plurality of pairs of vacant through holes 2321 (that is, the vacant through holes are not used) are defined on the fixing plate 232, and the positions of the plurality of pairs of through holes 2321 can be different, and the distances between them can be different for fixing the power supply body 251 having different sizes. The fixing plate 232 defines a plurality of rivet holes 2332 which are different in position and are vacant (that is, the through holes are not used). The rivet holes 2332 also can be used for fixing the power supply body 251 having different sizes. The power supply body 251 is fixed by the fixing strap 254 in the through hole 2322 of the fixing plate 232, so that the fixing and assembling method is simpler and the cost is lower. In addition, due to the recesses 2512 on the power supply body 251 and the fixing manner of the rivet 255, the fixing strength of the power supply body 251 is strengthened and the holding reliability is increased.

The embodiments shown and described above are only examples. Many details are often found in the art such as the other features of a protection case. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure, up to and including the full extent established by the broad general meaning of the terms used in the claims.

What is claimed is:

1. A lamp comprising:

a light source module comprising:

a circuit board provided with a plurality of light-emitting elements; and a fixing ring comprising:

an annular substrate;

a sidewall connected to an outer edge of the annular substrate; and at least two flanges disposed on an outer surface of the sidewall;

wherein the circuit board is disposed on the annular substrate and surrounded by the sidewall; and a shell module comprising:

a base comprising:

a first surface;

a second surface on an opposite side of the first surface;

a receiving cavity formed on the first surface; and at least two sliding slots defined on an inner wall of the receiving cavity, wherein the at least two flanges are received in the at least two sliding slots;

wherein the light source module further comprising a rubber ring and a lens, and the rubber ring and the lens and the circuit board are both received in a receiving space surrounded by the annular substrate and the sidewall, and the rubber ring is sandwiched between the annular substrate and the circuit board, and the base comprising a plurality of fins formed on the second surface.

2. The lamp as described in claim 1, further comprising a power module which comprising a power supply body connected with the light source module, and the shell module further comprising a fixing plate which is connected to the base, and the fixing plate defining at least one opening and comprising at least one fastener connected to an edge of one of the at least one opening, and the at least one fastener comprising two oppositely disposed first fasteners, and each first fastener comprising a holding plate connected to the edge of the at least one opening and a hook structure connected to an edge of the holding plate, and the power supply body being disposed on the fixing plate and received in a space surrounded by a plurality of fixing members, and the hook structure of each first fastener being hooked to one end of the power supply body away from the fixing plate.

3. The lamp as described in claim 2, wherein the hook structure is a prismatic shape, and one side of the prismatic shape presses against the power supply body, and a cross-section protrusion at one end of an edge of the at least one opening is formed in an arc, and the holding plate connects to the arc.

4. The lamp as described in claim 1, comprising a power module comprising a power supply body connected with the light source module, and the shell module further comprising a fixing plate which is connected to the base, and the fixing plate defining at least one pair of through holes, and the power supply body is disposed on the fixing plate, and the power module further comprising a fixing strap, and the fixing strap comprising a strap and a buckle connected to one end of the strap, and the other end of the strap passes through one pair of through holes in turn, and the buckle locks the other end of the strap.

5. The lamp as described in claim 4, wherein the power supply body comprising a shell and at least one recess formed at the junction of two sides of the shell, and the portion of the strap is received in the recess.

6. The lamp as described in claim 4, wherein the fixing plate further defines at least one rivet hole, and the power supply body further comprising at least one fixing piece extending from the surface of the power supply body, and the fixing piece contacts with the fixing plate, and the fixing piece defines at least one perforation, and the power module further defines at least one rivet, and the at least one rivet is fixed on the fixing plate by sequentially through the at least one perforation and the at least one rivet hole.

7. The lamp as described in claim 6, wherein the at least one rivet hole comprising a cap portion and a nail portion connected to the cap portion, and the nail portion comprising two outwardly facing hooks, and a gap is defined between the two hooks so that the nail portion can occur elastic deformation when passing through the perforation and the rivet hole, and then be fixed on the fixing plate.

8. The lamp as described in claim 1, wherein the base further defining an outlet hole formed in a bottom of the receiving cavity and comprising a waterproof buckle located on the second surface of the base, and the outlet hole runs through the base, and the waterproof buckle corresponding to the outlet hole, and the waterproof buckle comprising a base body formed on the base, a waterproof ring and a clip, and the base body defining a through hole penetrating the outlet hole and a receiving space adjacent to the waterproof ring and comprising two elastic buckles respectively extending from two sides of the base body, and the waterproof ring defines a through hole, and the clip defines a receiving space and a through hole penetrating the receiving space of the clip and two latching slots for engaging with the two elastic buckles, and the power module further comprising a conducting wire, and one end of the conducting wire is electrically connected to the circuit board, and the other end of the conducting wire is electrically connected to the power supply body by through the outlet hole, the through hole of the base body, the through hole of the waterproof ring and the through hole of the clip, and one end of the waterproof ring is received in the receiving space of the base body, and the other end of the waterproof ring is received in the receiving space of the clip, and the elastic buckle is matched with the slot of the clip so that the waterproof ring and the clip are fixed on the base body.

9. The lamp as described in claim 8, wherein the elastic buckle comprising an elastic plate extending from the lateral side of the base body and an arc-shaped clamping member disposed on a side of the elastic plate adjacent to the waterproof ring, when an external force is applied to the elastic plate to lead the arc-shaped clamping member to move away from the clip, the arc-shaped clamping member is opened to release the clip, and when an external force is applied to the elastic plate to lead the arc-shaped clamping member to move toward the clip, the arc-shaped clamping member is clipped with the clip.

10. A lamp comprising a light source module and a shell module, and the light source module comprising a circuit board provided with a plurality of light-emitting elements and a fixing ring, and the fixing ring comprising an annular substrate and at least two flanges disposed on the sidewall of the annular substrate, wherein the circuit board is disposed on the annular substrate and surrounded by the sidewall, and the shell module comprising a base, and the base comprising a receiving cavity formed on a surface of the base and at least two sliding slots defined on an inner wall of the receiving cavity, wherein the at least two flanges can be rotated and received in the at least two sliding slots for the circuit board receiving in the receiving cavity;

further comprising a power module which comprising a power supply body connected with the light source module, and the shell module further comprising a fixing plate which is connected to the base, and the fixing plate defining at least one opening and comprising at least one fastener connected to an edge of one of the at least one opening, and the at least one fastener comprising two oppositely disposed first fasteners, and each first fastener comprising a holding plate connected to the edge of the at least one opening and a hook structure connected to an edge of the holding plate, and the power supply body being disposed on the fixing plate and received in a space surrounded by a plurality of fixing members, and the hook structure of each first fastener being hooked to one end of the power supply body away from the fixing plate.

11. The lamp as described in claim 10, wherein the hook structure is a prismatic shape, and one side of the prismatic shape presses against the power supply body, and a cross-section protrusion at one end of an edge of the at least one opening is formed in an arc, and the holding plate connects to the arc.

12. A lamp comprising a light source module and a shell module, and the light source module comprising a circuit board provided with a plurality of light-emitting elements and a fixing ring, and the fixing ring comprising an annular substrate, a sidewall connected to an outer edge of the annular substrate and at least two flanges disposed on an outer surface of the sidewall, and the circuit board is received in a receiving space surrounded by the annular substrate and the sidewall, and the shell module comprising a base, and the base comprising a first surface, a second surface on an opposite side of the first surface, a receiving cavity on the first surface toward the second surface, and at least two sliding slots defined on an inner wall of the receiving cavity, wherein the at least two flanges can be rotated and received in the at least two sliding slots for the circuit board receiving in the receiving cavity, the base further defining an outlet hole formed in a bottom of the receiving cavity and comprising a waterproof buckle located on the second surface of the base.

13. The lamp as described in claim 12, further comprising a power module which comprising a power supply body connected with the light source module, and the shell module further comprising a fixing plate which is connected to the base, and the fixing plate defining at least one opening and comprising at least one fastener connected to an edge of one of the at least one opening, and the at least one fastener comprising two oppositely disposed first fasteners, and each first fastener comprising a holding plate connected to the edge of the at least one opening and a hook structure connected to an edge of the holding plate, and the power supply body being disposed on the fixing plate and received in a space surrounded by a plurality of fixing members, and the hook structure of each first fastener being hooked to one end of the power supply body away from the fixing plate.

14. The lamp as described in claim 12, wherein the waterproof buckle comprising a base body formed on the base, a waterproof ring and a clip, and the base body defining a through hole penetrating the outlet hole and a receiving space adjacent to the waterproof ring and comprising two elastic buckles respectively extending from two sides of the base body, and the waterproof ring defines a through hole, and the clip defines a receiving space and a through hole penetrating the receiving space of the clip and two latching slots for engaging with the two elastic buckles, and the power module further comprising a conducting wire, and one end of the conducting wire is electrically connected to the circuit board, and the other end of the conducting wire is electrically connected to the power supply body by through the outlet hole, the through hole of the base body, the through hole of the waterproof ring and the through hole of the clip, and one end of the waterproof ring is received in the receiving space of the base body, and the other end of the waterproof ring is received in the receiving space of the clip, and the elastic buckle is matched with the slot of the clip so that the waterproof ring and the clip are fixed on the base body.

15. The lamp as described in claim 14, wherein the elastic buckle comprising an elastic plate extending from the lateral side of the base body and an arc-shaped clamping member disposed on a side of the elastic plate adjacent to the waterproof ring, when an external force is applied to the elastic plate to lead the arc-shaped clamping member to move away from the clip, the arc-shaped clamping member is opened to release the clip, and when an external force is applied to the elastic plate to lead the arc-shaped clamping member to move toward the clip, the arc-shaped clamping member is clipped with the clip.

16. The lamp as described in claim 12, comprising a power module comprising a power supply body connected with the light source module, and the shell module further comprising a fixing plate which is connected to the base, and the fixing plate defining at least one pair of through holes, and the power supply body is disposed on the fixing plate, and the power module further comprising a fixing strap, and the fixing strap comprising a strap and a buckle connected to one end of the strap, and the other end of the strap passes through one pair of through holes in turn, and the buckle locks the other end of the strap.

17. The lamp as described in claim 16, wherein the power supply body comprising a shell and at least one recess formed at the junction of two sides of the shell, and the portion of the strap is received in the recess.

18. A lamp comprising a light source module and a shell module, and the light source module comprising a circuit board provided with a plurality of light-emitting elements and a fixing ring, and the fixing ring comprising an annular substrate and at least two flanges disposed on the sidewall of the annular substrate, wherein the circuit board is disposed on the annular substrate and surrounded by the sidewall, and the shell module comprising a base, and the base comprising a receiving cavity formed on a surface of the base and at least two sliding slots defined on an inner wall of the receiving cavity, wherein the at least two flanges can be rotated and received in the at least two sliding slots for the circuit board receiving in the receiving cavity;

the lamp further comprising a power module comprising a power supply body connected with the light source module, and the shell module further comprising a fixing plate which is connected to the base, and the fixing plate defining at least one pair of through holes, and the power supply body is disposed on the fixing plate, and the power module further comprising a fixing strap, and the fixing strap comprising a strap and a buckle connected to one end of the strap, and the other end of the strap passes through one pair of through holes in turn, and the buckle locks the other end of the strap.

* * * * *